US007784549B2

(12) United States Patent
Balen

(10) Patent No.: US 7,784,549 B2
(45) Date of Patent: Aug. 31, 2010

(54) SELF-PROPELLED SWABBING DEVICE AND METHOD

(75) Inventor: Robert Mark Balen, Calgary (CA)

(73) Assignee: Swab-Rite Tool Corp., Calgary (CA)

( * ) Notice: Subject to any disclaimer, the term of this patent is extended or adjusted under 35 U.S.C. 154(b) by 0 days.

(21) Appl. No.: 11/974,514

(22) Filed: Oct. 12, 2007

(65) Prior Publication Data

US 2008/0087438 A1 Apr. 17, 2008

Related U.S. Application Data

(63) Continuation of application No. 10/949,858, filed on Sep. 24, 2004, now abandoned.

(30) Foreign Application Priority Data

Sep. 24, 2003 (CA) ..... 2442223

(51) Int. Cl.
*E21B 34/08* (2006.01)
*E21B 43/18* (2006.01)

(52) U.S. Cl. ..... 166/372; 166/370; 166/68; 166/105; 166/369

(58) Field of Classification Search ..... 166/369, 166/38, 105, 370, 372; 251/65; 137/509, 137/510

See application file for complete search history.

(56) References Cited

U.S. PATENT DOCUMENTS 1,057,727 A 4/1913 Greenough
2,575,086 A * 11/1951 Atchison ..... 251/65
3,780,809 A * 12/1973 Ayers et al. ..... 166/374
4,165,762 A 8/1979 Acar
4,986,727 A 1/1991 Blanton
6,554,580 B1 4/2003 Mayfield et al.
7,021,387 B2 4/2006 Lee
2002/0174983 A1 11/2002 Swoyer et al.
2004/0065441 A1 4/2004 Bosley

FOREIGN PATENT DOCUMENTS

CA 2 355 500 A1 2/2003
CA 2 369 417 A1 7/2003

* cited by examiner

*Primary Examiner*—William P Neuder
*Assistant Examiner*—Brad Harcourt
(74) *Attorney, Agent, or Firm*—Pearne & Gordon LLP

(57) ABSTRACT

A self-propelled swabbing device and method for use in removing liquid to surface from within an installed wellbore casing. The device includes a longitudinally extending plunger sized to fit within said wellbore casing, and having an internal surface defining an internal flow passage extending longitudinally therethrough; a seal between said plunger and said wellbore casing; a valve stem including a valve operative to be shuttled between an opened position and a closed position to seal said internal flow passage, said valve stem extending longitudinally through said plunger to form a piston and sealed chamber maintained at a pressure below that desired for closing said valve; a biaser for biasing said valve in said opened position until a set pressure is reached, whereby said valve is shuttled to said closed position and flow through said internal flow passage is stopped; and a snap-closed device and a snap-open device for ensuring that said valve within said internal flow passage is either fully opened or fully closed until the set pressure is reached.

14 Claims, 4 Drawing Sheets

SELF-PROPELLED SWABBING DEVICE AND METHOD

This application is a continuation of U.S. patent application Ser. No. 10/949,858 filed Sept. 24, 2004, now abandoned.

FIELD OF THE INVENTION

The present invention relates generally to oil and natural gas well production devices and techniques, and more particularly to a swabbing device and method for the removal of liquids from wells incapable of lifting these liquids on their own.

BACKGROUND OF THE INVENTION

Wells that produce gas and liquids such as water, oil or petroleum condensates are often incapable of clearing the liquids from the wellbore as gas is produced, especially in depleted reservoirs and low-rate gas wells. These liquids accumulate over time until they exert enough backpressure within the wellbore and on the reservoir to reduce the flow of natural gas, or stop it completely.

Prior art methods for dealing with this problem have included the use of down-hole pumps. The problem is that these methods are labor intensive, require regular attention by employees, and some use expensive equipment to provide an external source of lifting capacity to clear the wellbore of the liquids.

What is needed is a way to optimize the production from oil and gas wells where the reservoir delivers a sufficient quantity of gas to lift the accumulated liquids to surface using the reservoir's own energy. In addition, any proposed solution should be capable of running automatically once set for the operating conditions of a particular well without need for constant attention.

For the foregoing reasons, there is a need for an improved device for swabbing wellbores.

SUMMARY OF THE INVENTION

The present invention is directed to a self-propelled swabbing device and method for use in removing liquids to surface from within an installed wellbore casing. The device includes a longitudinally extending plunger sized to fit within the wellbore casing, and has an internal surface defining an internal flow passage that extends longitudinally therethrough.

The device further includes a seal between the plunger and the casing, and a valve stem having a valve operative to be shuttled between an opened position and a closed position to seal the internal flow passage. The valve stem extends longitudinally through the plunger to form a piston and sealed chamber maintained at a pressure below that desired for closing the valve. A biaser is further included for biasing the valve in the opened position until a set pressure is reached, whereby the valve is shuttled to the closed position and flow through the internal flow passage is stopped.

In an aspect of the present invention, the biaser is located within the sealed chamber. In another aspect of the present invention, the biaser forms one or more surfaces defining the sealed chamber.

In another aspect of the present invention, the device further includes a snap-closed/snap-open device for ensuring that the valve remains fully open until reaching the set pressure, and a positive seal is maintained to prevent any leakage through the internal flow passage from events such as pressure changes during ascent.

The self-propelled swabbing method includes the steps of sealing spacing between the wellbore casing and a swabbing device having a valve, biasing the valve in an opened position until a set pressure is reached, allowing liquid to flow from below, through and above the swabbing device while the valve is opened, allowing the valve to close upon achieving the set pressure created by the liquid accumulating above the swabbing device, allowing pressure from liquids and/or gases within the wellbore and below the swabbing device to build below the swabbing device until combined weight of the swabbing device and accumulated liquid are overcome by the building pressure and begin to rise to surface, releasing the trapped liquid at surface; and allowing the valve to open upon a set pressure once the trapped liquid is released, enabling the swabbing device to fall back to bottom.

No external power is required when using the device, and none of the physical infrastructure or cost that goes with that requirement. The device is also cheap and efficient to run.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PRESENTLY PREFERRED EMBODIMENT

Figure 1:
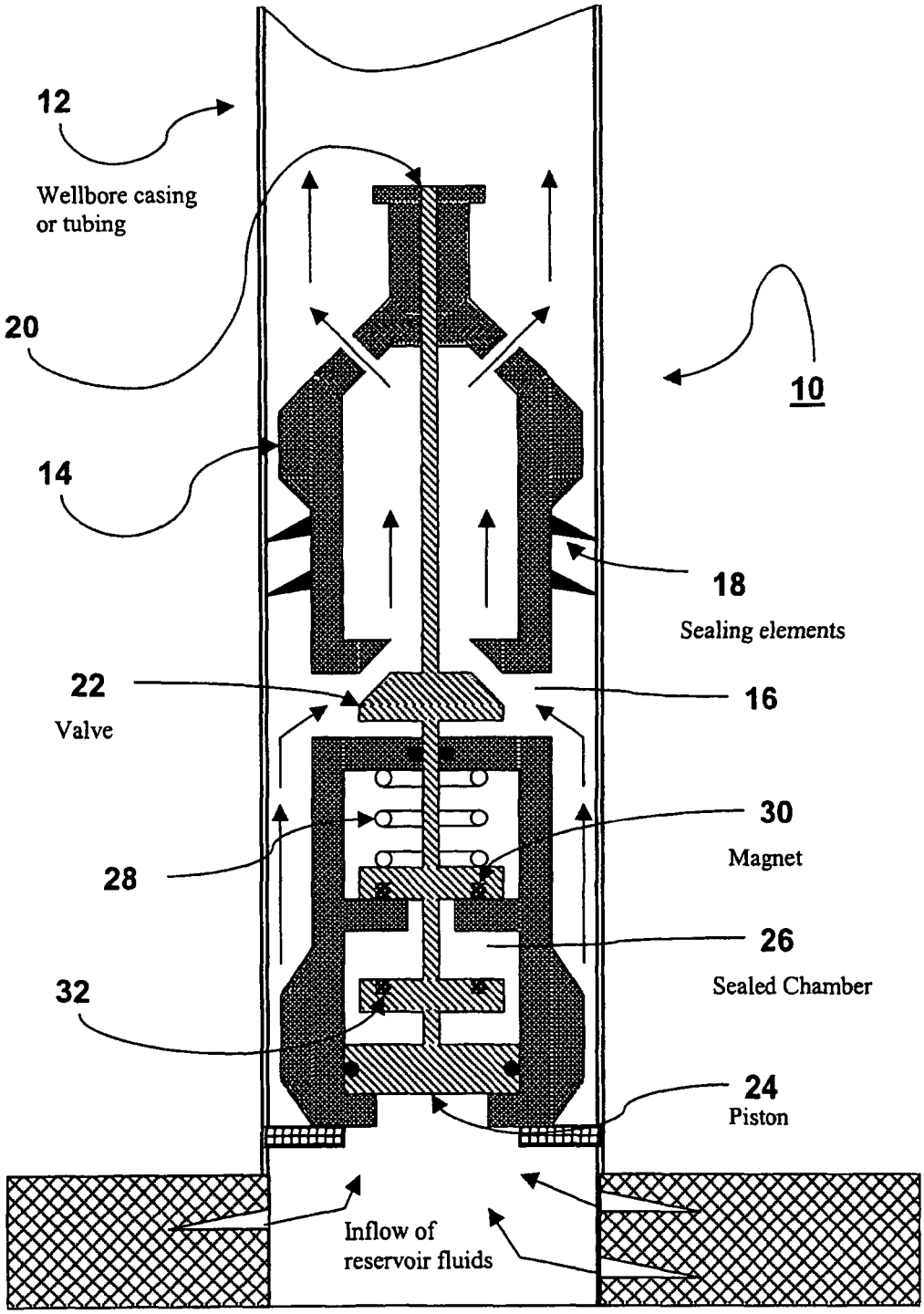
FIG. 1 illustrates a self-propelled swabbing device at the bottom of a well in accordance with an embodiment of the present invention.

An embodiment of the present invention is directed to a self-propelled swabbing device 10 and method 100 for use in removing liquids to surface from within an installed wellbore casing 12. As illustrated in FIG. 1, the device 10 includes a longitudinally extending plunger 14 sized to fit within the wellbore casing 12, and has an internal surface defining an internal flow passage 16 extending longitudinally therethrough.

The device 10 further includes a seal 18 between the plunger 14 and the casing 12, and a valve stem 20 having a valve 22 operative to be shuttled between an opened position and a closed position to seal the internal flow passage 16. The valve stem 20 extends longitudinally through the plunger 14 to form a piston 24 and sealed chamber 26 maintained at a pressure below that desired for closing the valve 22. A biaser 28 is further included for biasing the valve stem 20 in the opened position until a set pressure is reached, whereby the valve 22 is shuttled to the closed position and flow through the internal flow passage 16 is stopped.

In an embodiment of the present invention, the device 10 further includes a snap-closed device 30 in the form of a magnet for ensuring that the valve 22 does not partially close until the set pressure is reached. A snap-open device 32 in the form of a magnet is included to ensure that a positive seal is maintained to prevent any leakage through the internal flow passage 16 from such things as pressure changes during ascent and to enable the valve 22 to shuttle from closed to fully open once the pressure is reduced.

Figure 2:
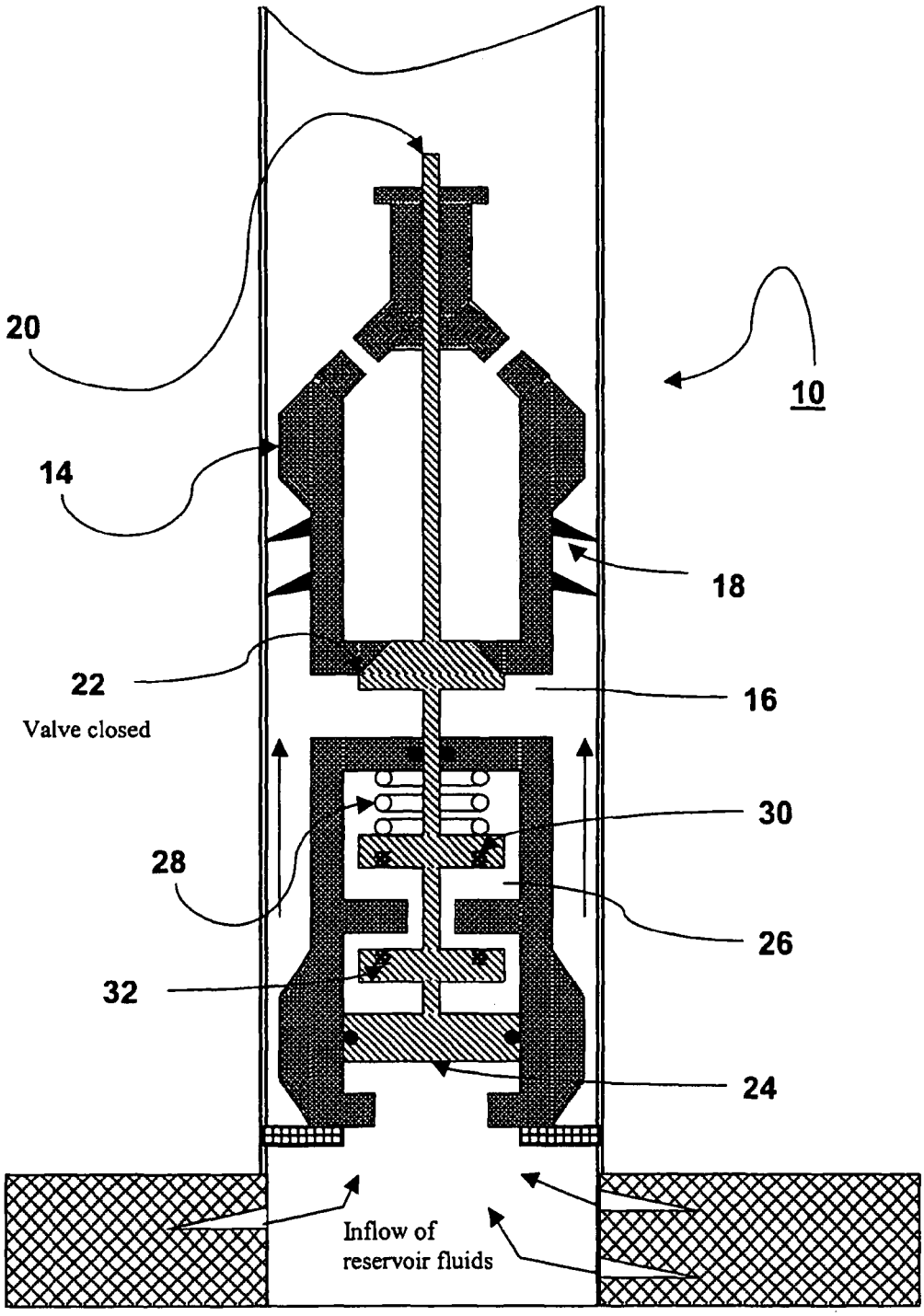
FIG. 2 illustrates the valve closed with pressure building.
Figure 3:
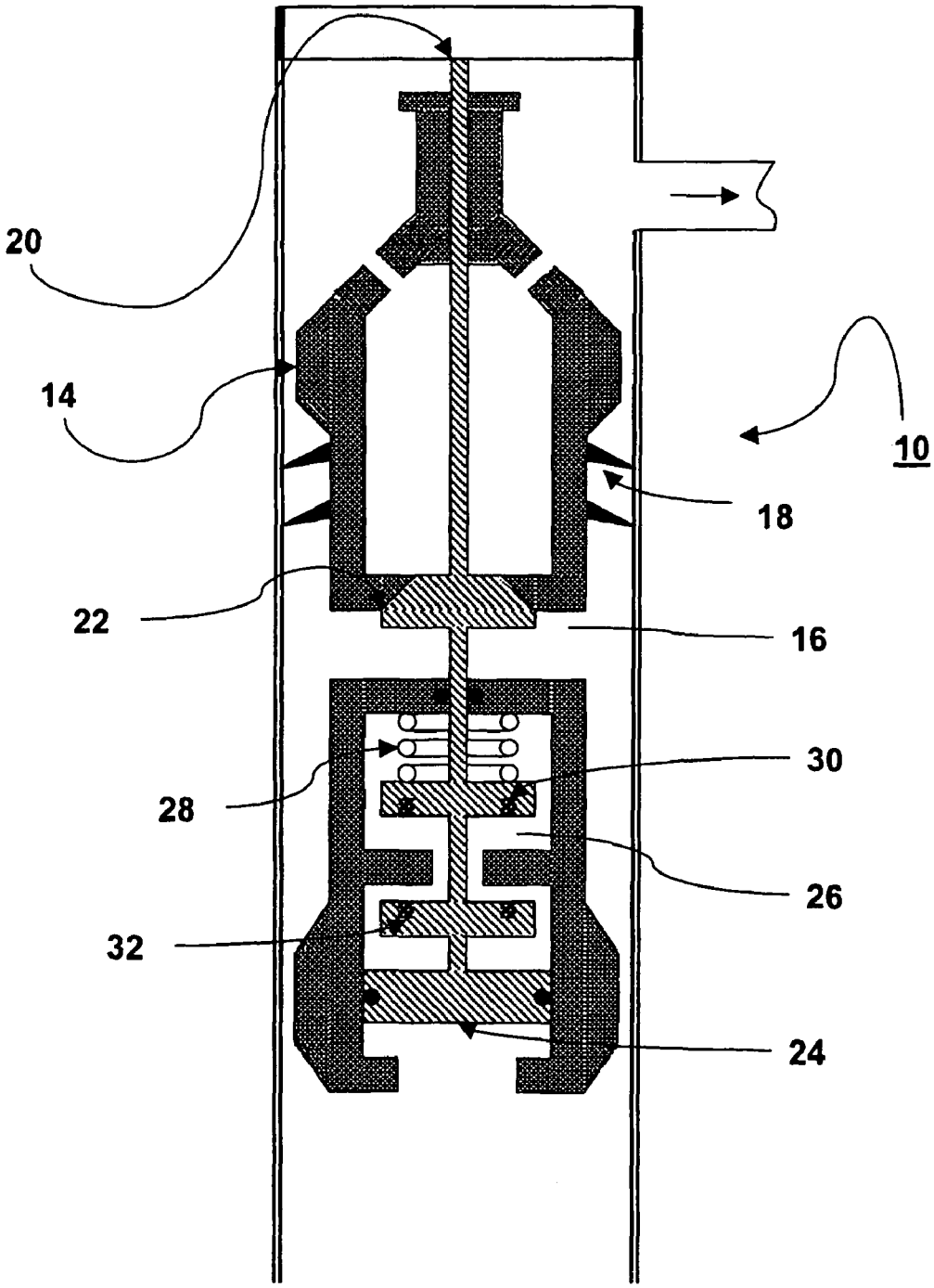
FIG. 3 illustrates the valve about to be bumped open.

In an embodiment of the present invention shown in FIGS. 1-3, the biaser 28 is located within the pressurized sealed chamber 26 in the form of a coil spring. In another embodiment of the present invention shown in FIG. 4, the biaser 28 forms elements of the pressurized sealed chamber 26.

The self-propelled swabbing method 100 includes the steps of sealing spacing between the wellbore casing and a swabbing device having a valve, biasing the valve in an opened position until a set pressure is reached, allowing liquid to flow from below, through and above the swabbing device while the valve is opened, allowing the valve to close upon achieving the set pressure created by the liquid accumulating above the swabbing device, allowing pressure from liquids and/or gases within the wellbore and below the swabbing device to build below the swabbing device until combined weight of the swabbing device and accumulated liquid are overcome by the building pressure and begin to rise to surface, releasing the trapped liquid at surface; and allowing the valve to open upon a set pressure once the trapped liquid is released, enabling the swabbing device to fall back to bottom.

When the valve 22 seals the internal flow passage 16, the reservoir pressure builds below the plunger 14 and pushes the plunger 14 and all fluids above the plunger 14 to surface out of the wellbore 12.

Figure 4:
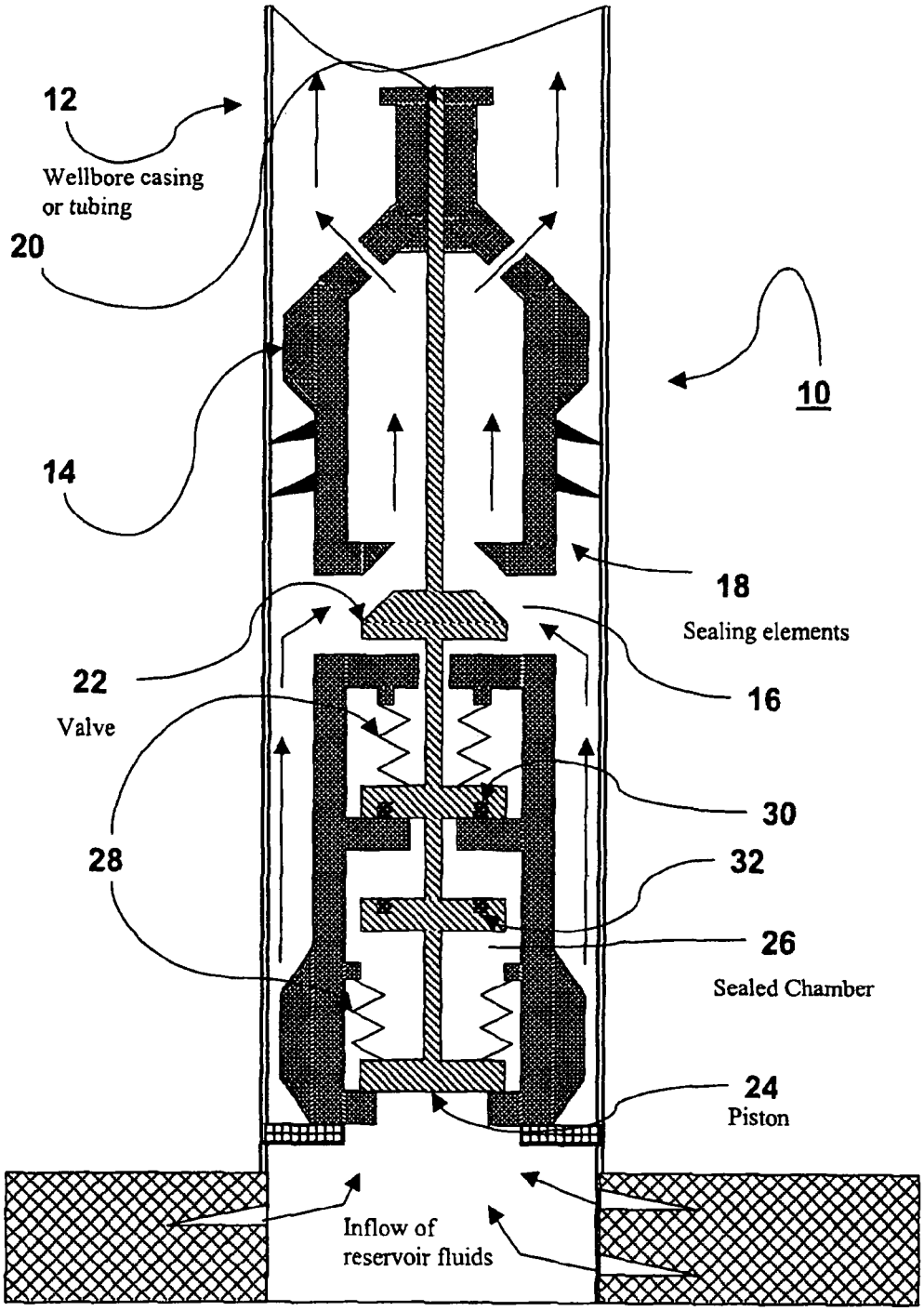
FIG. 4 illustrates a variation of the embodiment shown in FIGS. 1-3.

FIG. 1 shows the device 10 at the bottom of a well, resting on top of a landing platform located above the perforations that are producing the gas that will provide the energy to drive the device 10 to surface. A seal 18 is provided between the plunger 14 body and the wellbore 12, forcing the reservoir fluids to flow through the internal flow passage 16 of the device 10. The liquids produced collect above the device 10 slowly increasing the backpressure exerted on the reservoir. A spring and the pressurized sealed chamber 26 provide the force to bias the valve stem 20 in the opened position. The embodiment shown in FIG. 4 illustrates a variation of the biaser 28 shown in FIGS. 1-3 that achieves the same results. As the liquids accumulate around and above the device 10, the external pressure is increased on the valve stem 20 and the piston 24 until a set pressure is reached, which then overcomes the magnet force and pressure within the sealed chamber 26, with the result that the valve 22 shuttles to the closed position.

As illustrated in FIG. 2, once the valve 22 has closed, the pressure will build below the device 10 until the weight of the device 10 is overcome, and the device 10 is pushed to surface by the reservoir gases. Since the piston 24 is located on the high-pressure side of the device 10, the additional pressure required to lift the device 10 and overcome the frictional forces helps to ensure that the valve 22 remains in the closed position until the liquids are delivered to surface. With the valve 22 closed, the device 10 and liquids above it are pushed to surface, out a flow tee and into a pipeline.

As illustrated in FIG. 3, at the top of the wellbore 12, the valve 22 is pushed open as the extending end of the valve stem 20 contacts a striker plate, with the result that the pressure is equalized across the device 10 allowing it to fall back to bottom to pick up the next liquid load. The plunger 14 is sized such that while falling back to bottom, differential pressure along the length of the plunger 14 is less than the pressure required to support the plunger 14. If the pressure at the piston is reduced sufficiently to overcome the snap-open device 32 magnetic force, the valve 22 will shuttle to the open position without contacting the striker plate.

A mechanism has been included in an embodiment of the device 10 that enables the valve 22 to snap-closed and snap-open. Springs are generally linear devices that would allow the valve 22 to close proportionately to the pressure as it increases to the set close pressure. As the valve closes the pressure differential across the valve from the gas flow also increases. Without the snap-closed device 30, it is possible for the valve to partially close and for the pressure differential across the device 10 to increase sufficiently to lift the device 10 pre-maturely and deliver a partial load of liquids. As well, the device 10 may become hydraulically stuck in the wellbore 12 as it begins to rise, hovering in place until an increase in pressure closes the valve 22 completely or the pressure decreases allowing the valve 22 to open and the device 10 to fall back down the wellbore 12 to pick up additional liquids. Without the snap-open device 32, the valve 22 can partially open causing it to hover in the wellbore instead of descending to pick up additional liquids.

No external power is required when using the device 10 or employing the method, and none of the physical infrastructure or cost that goes with that requirement. The device 10 is also cheap and efficient to run.

The device 10 and method optimize the production from oil and gas wells where the reservoir delivers a sufficient quantity of gas to lift the accumulated liquids to surface using only the reservoirs own energy. The device 10 is designed to run automatically once set for the operating conditions of a particular well.

Although the present invention has been described in considerable detail with reference to certain preferred embodiments thereof, other versions are possible. Therefore, the spirit and scope of the appended claims should not be limited to the description of the preferred embodiments contained herein.

What is claimed is:

1. A self-propelled swabbing device for use in removing liquid to surface from within an installed wellbore casing, said device comprising:

a longitudinally extending plunger sized to fit within said wellbore casing, and having an internal surface defining an internal flow passage extending longitudinally therethrough;

a seal between said plunger and said wellbore casing;

a valve stem including a valve operative to be shuttled between an opened position allowing flow through said internal flow passage and a closed position to seal said internal flow passage when a set pressure is reached, said valve stem extending longitudinally through said plunger to form a piston and a sealed chamber;

a biaser for biasing said valve toward said opened position;

a snap-closed device for ensuring that said valve is fully open in the opened position; and a snap-open device for ensuring that said valve is fully closed in said closed position, wherein said snap-closed and snap-open devices comprise a member located on said valve stem, wherein one or both of said snap-closed device and said snap-open device includes a magnet.

2. The device according to claim 1, wherein said biaser is located within said sealed chamber.

3. The device according to claim 2, wherein said biaser forms one or more surfaces defining said sealed chamber.

4. The device according to claim 2, wherein said biaser is a spring.

5. The device according to claim 4, wherein said spring is a coil spring.

6. The device according to claim 1, wherein said valve opens automatically upon removal of trapped liquids, thereby allowing said plunger to fall back to bottom.

7. The device according to claim 6, wherein said valve stem extends beyond a surface end of said plunger for striking a strike plate once said plunger delivers accumulated liquids to surface to forcibly push said valve to said opened position and equalize pressure across said device, thereby allowing said plunger to fall back to bottom.

8. The device according to claim 1, wherein said valve stem and said piston are exposed to a high pressure side of said valve once said valve is in the closed position thereby ensuring that the valve remains closed until liquid has been removed to the surface.

9. A self-propelled swabbing method for removing liquid to surface from within an installed wellbore casing, said method comprising the steps of:

sealing spacing between said wellbore casing and a swabbing device having a valve stem including a valve;

biasing said valve in an opened position until a set pressure is reached;

allowing liquid to flow from below, through and above said swabbing device while said valve is opened;

allowing said valve to close upon achieving said set pressure created by said liquid accumulating above said swabbing device;

allowing pressure from liquids and/or gases within said wellbore and below said swabbing device to build below said swabbing device until combined weight of said swabbing device and accumulated liquid are overcome by said building pressure and begin to rise to surface;

releasing said trapped liquid at surface; and allowing said valve to open upon the set pressure once said trapped liquid is released, enabling said swabbing device to fall back to bottom;

wherein said valve is snapped open by a snap-closed device and snapped closed by a snap-open device to avoid partial opening and closing of said valve, wherein one or both of said snap-closed device and said snap-open device includes a magnet.

10. A self-propelled swabbing device for use in removing liquid to surface from within an installed wellbore casing, said device comprising:

a longitudinally extending plunger sized to fit within said wellbore casing, and having an internal surface defining an internal flow passage extending longitudinally therethrough;

a seal between said plunger and said wellbore casing;

a valve stem including a valve operative to be shuttled between an opened position allowing flow through said internal flow passage and a closed position to seal said internal flow passage when a set pressure is reached, said valve stem extending longitudinally through said plunger to form a piston and a sealed chamber;

a biaser for biasing said valve toward said opened position;

a snap-closed device for ensuring that said valve is fully open in the opened position; and a snap-open device for ensuring that said valve is fully closed in said closed position, wherein said snap-open device is located in the sealed chamber and engages both the valve stem and a surface of the sealed chamber for ensuring the valve does not close until a set pressure is reached; and wherein said snap-closed device is located in the sealed chamber and engages both the valve stem and a surface of the sealed chamber for ensuring the valve does not open until a set pressure is reached.

11. The device according to claim 10, wherein the snap-open and snap-closed devices each comprise a radially extending member located on said valve stem for engaging the surface of the sealed chamber, wherein the surface comprises an annular member extending into the sealed chamber from a wall of the sealed chamber.

12. The device according to claim 11, wherein the snap-open and snap-closed devices further comprise magnets located on each radially extending member and the annular member.

13. The device according to claim 10, wherein the snap-open and snap-closed devices each comprise an annular member extending into the sealed chamber from a wall of the sealed chamber for engaging a radially extending member located on said valve stem.

14. The device according to claim 13, wherein the snap-open and snap-closed devices further comprise magnets located on the radially extending member and each annular member.

* * * * *